United States Patent [19]

Viola et al.

[11] 4,374,368

[45] Feb. 15, 1983

[54] MULTILEVEL STRIPLINE TRANSITION

[75] Inventors: Raymond D. Viola, Oyster Bay; Gerard L. Hanley, Melville, both of N.Y.

[73] Assignee: Sperry Corporation, New York, N.Y.

[21] Appl. No.: 220,226

[22] Filed: Dec. 29, 1980

[51] Int. Cl.[3] ..... H01P 5/12

[52] U.S. Cl. ..... 333/128; 333/116; 333/246

[58] Field of Search ..... 333/116, 128, 238, 246

[56] References Cited

U.S. PATENT DOCUMENTS 3,715,689 2/1973 Laughlin ..... 333/128

*Primary Examiner*—Paul L. Gensler

*Attorney, Agent, or Firm*—Howard P. Terry; Seymour Levine

[57] ABSTRACT

A multilevel stripline transformer which transforms the center strips of a one level stripline system to a common ground plane between levels of a multilevel stripline system. The upper and lower ground planes of the one level system are each ribboned to form extensions of inner strips of the one level system, which are converted alternately to upper and lower level microstrips having the common ground plane as its ground plane. These upper and lower level microstrips are then transformed to be the center conductors of the upper and lower levels of the multilevel stripline system.

2 Claims, 5 Drawing Figures

MULTILEVEL STRIPLINE TRANSITION

BACKGROUND OF THE INVENTION

1. Field of the Invention

The invention pertains to stripline couplers and more particularly to the transformation of a multiplicity of stripline circuits at a common level into a two level system each with a plurality of stripline circuits.

2. Description of the Prior Art

In many stripline systems, it is necessary to couple a multiplicity of circuits at a common level to circuits contained at a plurality of levels. One method employed in the prior art for accomplishing this utilizes cables and connectors. Such an approach requires stripline to cable transformations and interconnecting cables between the circuits. This coupling method is costly and introduces losses that affect the system adversely. It is desirable to eliminate the cables and the concomitant stripline to cable transformations.

SUMMARY OF THE INVENTION

A transformer for coupling a multiplicity of stripline circuits at a common level to stripline circuits at a plurality of levels in accordance with the principles of the present invention includes an input section with upper and lower ground planes having a multiplicity of strip conductors therebetween. The strip conductors are flared until they merge into a solid metallic sheet which is positioned as the common ground plane between two decks of stripline circuits. This common ground plane being the lower ground plane of the upper deck and the upper ground plane of the lower deck. In the flared transition section, the upper ground plane of the input section is ribboned to form strip conductors which traverse an upper microstrip section as extensions of alternate strip conductors of the input section. These strip conductors emerge from the upper microstrip section as the strip conductors between the common ground plane and the upper ground plane of the upper deck. Similarly, the lower ground plane of the input section is ribboned to form strip conductors which traverse a lower microstrip section as extensions of the strip conductors of the input section which alternate with the strip conductors of which the strip conductors formed from the upper ground plane are extensions. The strip conductors formed from the lower ground plane emerge from the lower microstrip region as the strip conductors between the common ground plane and the lower ground plane of the lower deck.

DESCRIPTION OF THE PREFERRED EMBODIMENTS

Figure 1:
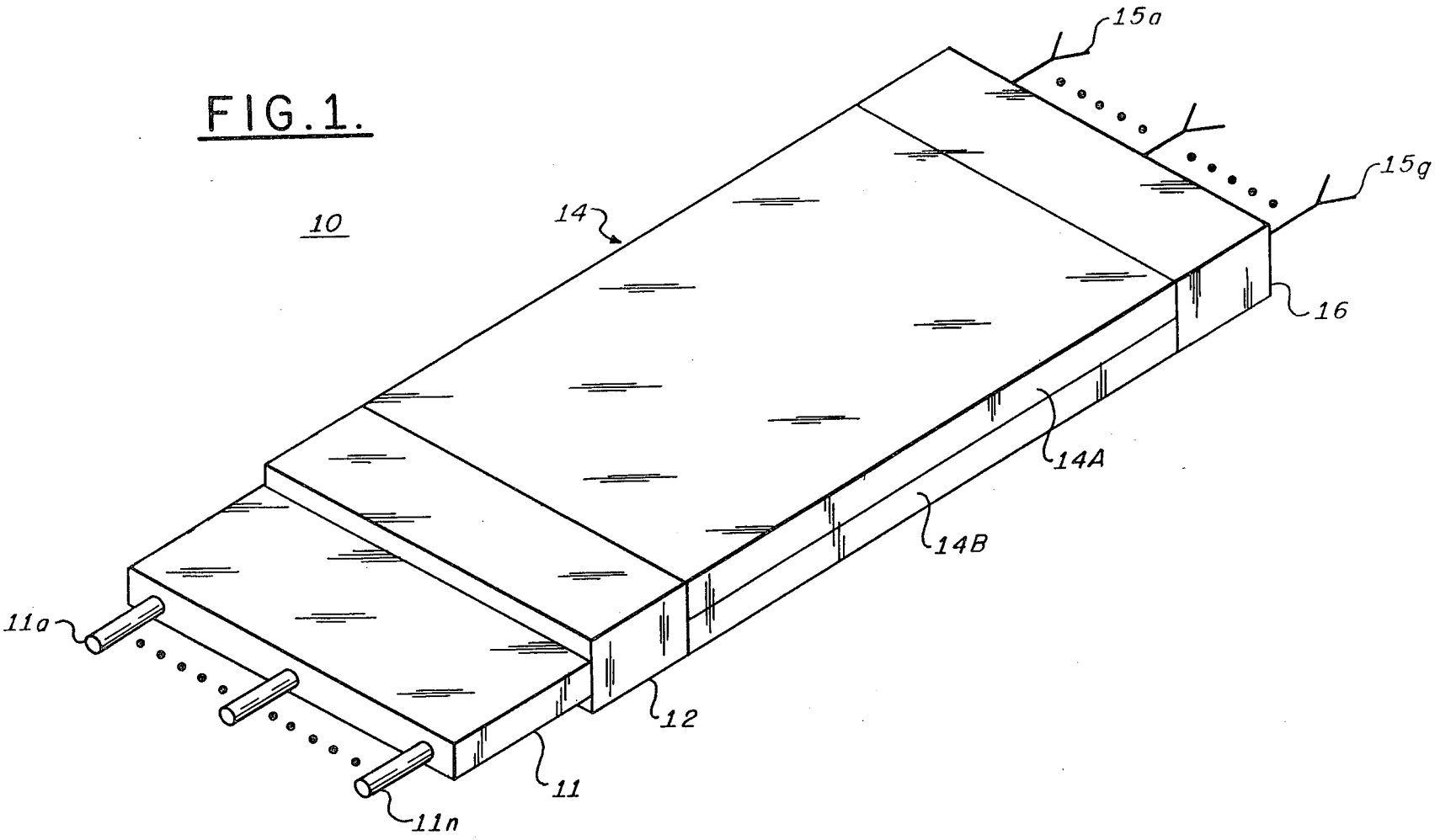
FIG. 1 is a block diagram of an antenna system which utilizes the principles of the present invention.

The present invention has application in many stripline systems, a block diagram of one, a multibeam antenna system, is shown in FIG. 1. Referring to FIG. 1, a multibeam antenna system 10 includes a power divider 11 utilized to couple signals incident to each of the input terminals 11*a* through 11*n* to at least two input terminals of a deck level transformer 12 which incorporates the principles of the present invention. Each of the input terminals of deck level transformer 12 is coupled to a designated inner conductor of a symmetrical stripline system on a preselected deck of at least two decks of stripline circuitry forming Butler matrix 14. The output ports of each deck of the Butler matrix are in symmetric stripline and are uniformly distributed in the central planes of each deck. These output ports are transformed to a common level and appropriately coupled to co-planar antenna elements 15*a* through 15*q* by element level transformer 16.

Figure 2:
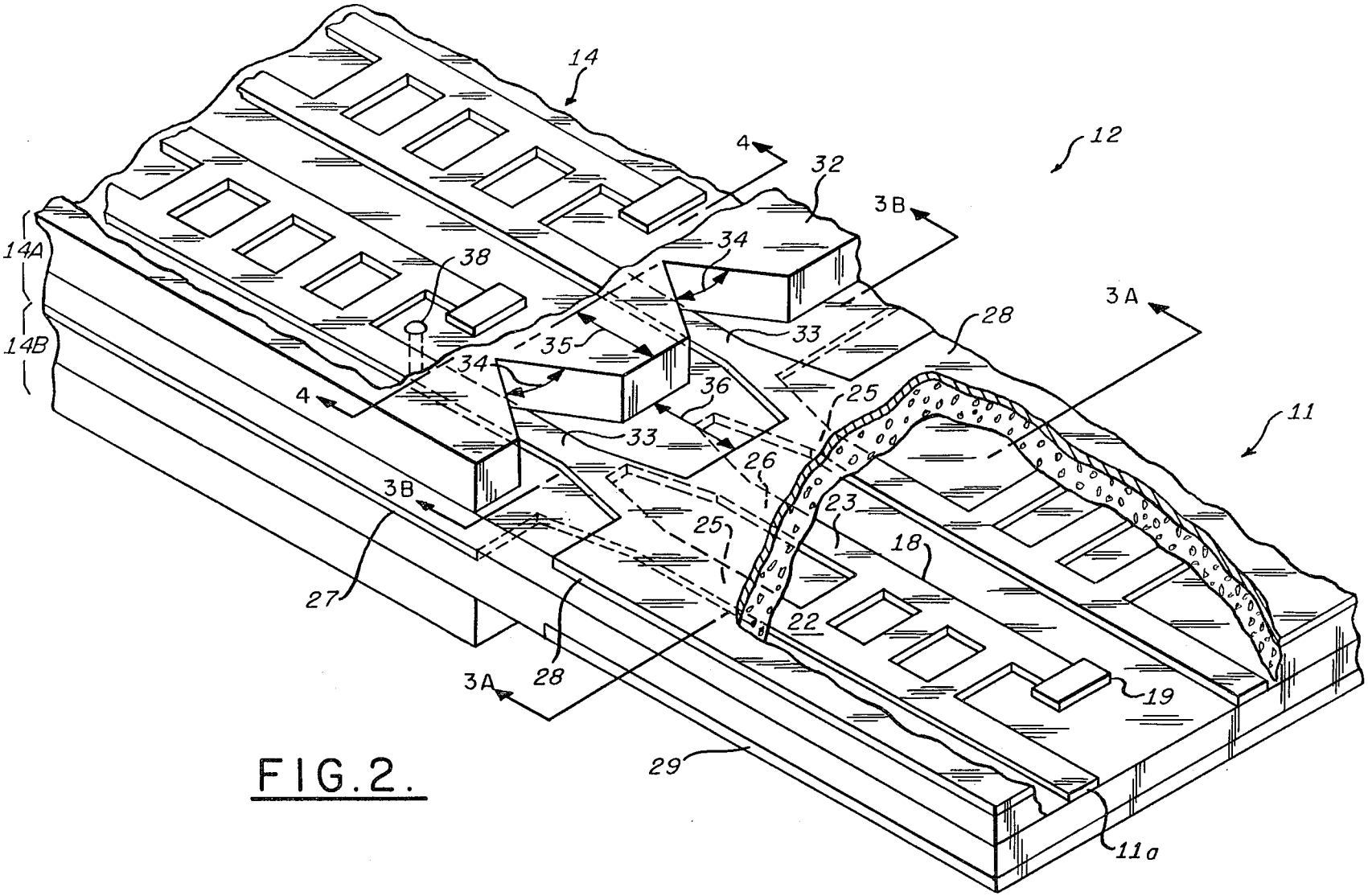
FIG. 2 is an illustration of the deck level transformer which utilizes the principles of the present invention.

Coupling each input port 11*a* through 11*n* to the two decks of the Butler matrix 14A and 14B of the Butler matrix 14 may be accomplished through the power divider 11 and the deck level coupler 12 shown in FIG. 2. An input port, as for example port 11*a*, is coupled to one arm of a three branch 3 dB stripline coupler 18, the adjacent arm of which is coupled to a matched termination 19 while the output ports 22 and 23 are coupled to the input striplines 25 and 26 of the deck level coupler 12. Deck level coupler 12 may be constructed by transforming the input striplines 25 and 26 to the common ground plane 27 of the decks 14A and 14B and converting the upper 28 and lower 29 ground planes at the input end of the deck level coupler 12 to the center conductors of the upper deck 14A and lower deck 14B respectively.

Figure 3A:
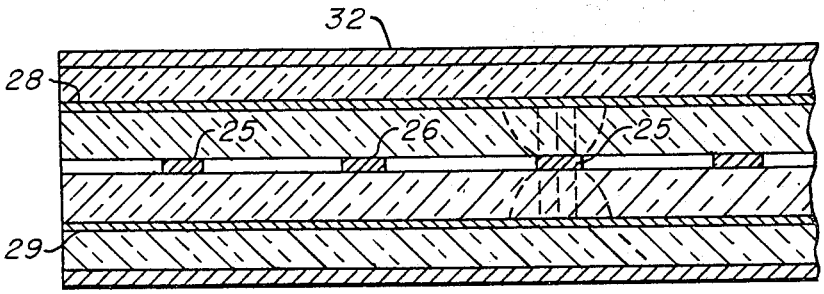
FIGS. 3A, 3B and 4 are cross-sectional views taken through selected sections of the deck level transformer of FIG. 2.
Figure 3B:
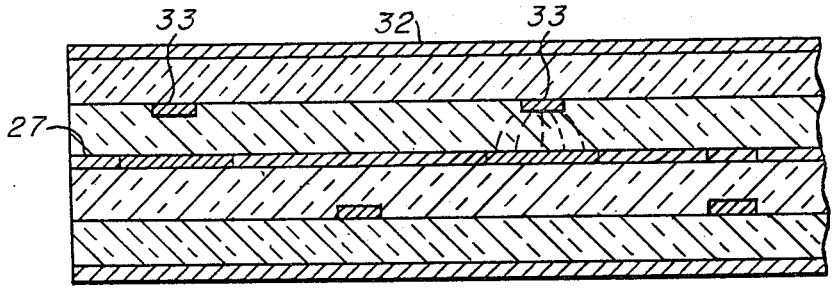
Figure 4:
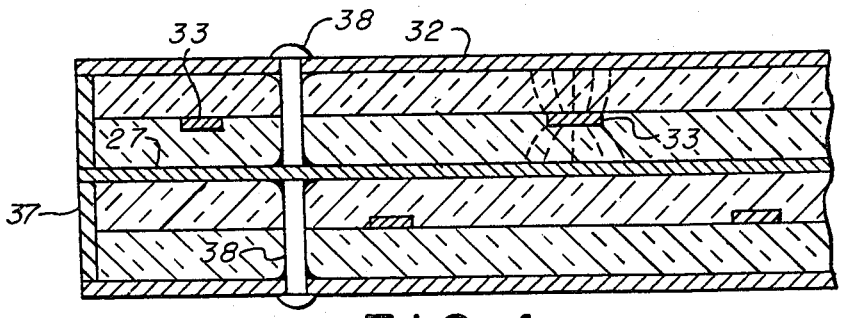

Commencing with the multi-deck section of the deck level coupler 12, the upper ground plane 32 is gradually removed in the vicinity of the stripline conductors 33 with a taper angle 34 which extends a distance 35 from the apex after which the ground plane is completely removed establishing a microstrip circuit over this distance for the center conductors 33. The center conductors 33 are broadened using a broadening angle similar to the angle 34 for a distance 36 after which all center conductors 33 merge with the ground plane 28 of the symmetrical stripline section of the deck level coupler 12 which couples to the power divider 11. Over the distance 36 the center strips 25 of the symmetrical stripline section are similarly tapered to merge with the common ground plane 27 between the upper deck 14A and the lower deck 14B. This transition is shown in cross-section in FIGS. 3A, 3B and FIG. 4. In a similar manner, the center strips 26 are merged with the common ground plane 27 and the center strips of the lower deck 14B are converted to the lower ground plane 29 of the symmetrical stripline section of the deck level coupler 12. All ground planes may be maintained at the same potential by means of edge plates 37 and/or grounding pins 38 which run vertically through the entire assembly and soldered to each of the ground planes.

While the invention has been described in its preferred embodiment, it is to be understood that the words which have been used are words of description rather than limitation and that changes may be made within the purview of the appended claims without departing from the true scope and spirit of the invention in its broader aspects.

We claim:

1. A stripline transformer comprising:

an input section having first and second ground planes and a multiplicity of inner conductors therebetween;

first and second stripline decks having a common ground plane therebetween each with a ground plane substantially parallel to said common ground plane positioned a predetermined distance therefrom and each with inner conductors positioned between said common ground plane and said substantially parallel ground plane;

first and second microstrip sections coupled between said input section and said first and second stripline decks respectively, each having conductors a predetermined distance from a ground plane extending from said common ground plane, said conductors of said first microstrip section coupled between said inner conductors of said first stripline deck and said first ground plane of said input section, said conductors of said second microstrip section coupled between said inner conductors of said second stripline deck and said second ground plane of said input section, and said ground plane extending from said common ground plane coupled to said inner conductors of said input section, thereby providing a transformation from one stripline to two striplines arranged in a double deck configuration.

2. A stripline transformer in accordance with claim 1 wherein said input section and said first and second stripline decks are each symmetric striplines.

* * * * *